United States Patent [19]

Frink, deceased

[11] Patent Number: 4,568,806

[45] Date of Patent: Feb. 4, 1986

[54] MULTIPLE ARC REGION $SF_6$ PUFFER CIRCUIT INTERRUPTER

[75] Inventor: Russell E. Frink, deceased, late of Port Orchard, Wash., by Ruth M. Frink, administrator

[73] Assignee: Siemens-Allis, Inc., Atlanta, Ga.

[21] Appl. No.: 655,150

[22] Filed: Sep. 27, 1984

[51] Int. Cl.[4] ..... H01H 33/88

[52] U.S. Cl. ..... 200/148 A; 200/145

[58] Field of Search ..... 200/148 A, 145

[56] References Cited

U.S. PATENT DOCUMENTS 3,588,407 6/1971 Frink ..... 200/148 R
3,943,314 3/1976 Frink ..... 200/148 A
4,000,387 12/1976 Millianowicz ..... 200/148 A
4,328,403 5/1982 Frink et al. ..... 200/148 A

*Primary Examiner*—Robert S. Macon
*Attorney, Agent, or Firm*—F. W. Powers; J. L. James

[57] ABSTRACT

A puffer-type compressed-gas circuit-interrupter is provided having a tubular stationary and at least two movable contacts which draw at least two arcs within at least two regions in the interrupter. The two regions are connected by a series of insulating flow guides, tubular contacts, and an insulating nozzle to a single fluid motor which during contact opening, after a predetermined portion of the opening travel of the interrupter, provides a blast of puffer gas extinguishing the arcs.

18 Claims, 4 Drawing Figures

MULTIPLE ARC REGION $SF_6$ PUFFER CIRCUIT INTERRUPTER

TECHNICAL FIELD

This invention relates to electrical circuit interrupters and, more particularly, to a puffer circuit interrupter with enhanced power handling capability.

BACKGROUND OF THE INVENTION

The continued growth and industrialization of the country demands an increase in the amount of electrical power supplied. These higher urban load current densities in conjunction with the scarcity of available space for substation construciton in urban areas present a problem for power distribution systems. In the past, larger loads have been accommodated by increases in the size of substation circuit-breakers. However, for current connection and disconnection, it is desirable to replace these larger circuit-breakers with smaller devices to meet the increasing demand for electrical power.

Load-breaker-disconnecting-switches as a smaller alternative to the larger circuit-breakers are well known in the art. Some earlier load-breaker-disconnecting-switches employed a circuit interrupter electrically in series with a disconnecting switch and mechanically linked to operate in concert. This combination increased the current disconnecting capacity of the load-breaker-disconnecting-switch without a corresponding increase in size.

Modern high current circuit-breakers are reliable and perform their duties adequately. However, they are physically large and expensive. Where space is a limiting factor, circuit-breakers must acommodate current disconnection requirements in the available space or be replaced by a more space efficient current disconnecting device. Therefore, it is highly desirable to have circuit interrupters which have increased current connection and disconnection capability without increased physical size to replace the corresponding capacity circuit-breakers.

Over the past few years, the circuit interrupter coupled to a disconnecting switch combination has been replaced by a modern circuit interrupter which can connect and disconnect current without the necessity of a series disconnecting switch. This has been accomplished by constructing circuit interrupters which extinguish the arc drawn on disconnection with a jet of a highly insulating gas such as sulfur-hexafluoride. These circuit interrupters are called puffer-type circuit interrupters because of the jet or puff of gas used to extinguish the arc. Because the circuit interrupters are filled and sealed with a gas more insulating than air, a smaller contact distance is required to prevent further arcing once the initial arc is extinguished, therefore leading to smaller equipment. Circuit interrupting devices of this type are set forth in U.S. Pat. No. 3,943,314 which issued Mar. 9, 1976 to Frink, U.S. Pat. No. 4,000,387 which issued Dec. 28, 1976 to Milianowicz, U.S. Pat. No. 4,328,403 which issued May 6, 1982 to Frink et al., and U.S. Pat. No. 3,588,407 issued June 28, 1971 to Frink.

These patents disclose circuit interrupters which operate effectively in a confined space and have a low noise level during the interruption. However, the circuit interrupters taught by Frink and Milianowicz puff only a single volume of sulfur-hexafluoride gas upon a single arc to extinguish it. This puffer circuit interrupter design is limited because the volume of puffer gas can only cool and extinguish so many kilo amperes of arc current. Therefore, to increase the current interrupting capabilities of the prior art design, the volume of available puffer gas would have to be increased which would mean either an increase in the length of the interrupter, or an increased cross sectional area of the puffer mechanism leading to an increased diameter of the interrupter. It is desirable to have a puffer type circuit interrupter that has increased power disconnecting capacity yet without an increased physical size.

SUMMARY OF THE INVENTION

The present invention is provided to overcome one or more of the problems set forth above. According to the present invention, a puffer circuit interrupter has an insulating tube means having first and second spaced external terminal means thereon communicating with the internal portion of said tube means. A first electrical contact means is disposed within the tube means in electrical contact with the first external terminal means. A second electrical contact means is also disposed within the tube means in electrical contact with the second external terminal means. A third electrical contact means is disposed within the tube means and is movable relative to the first and second contact means. A fluid motor means is disposed upon the first contact means. The fluid motor means defines a chamber and has an opening therein which controllably communicates with at least a first arc region between the first and third contact means and at least a second arc region between the second and third contact means. Puffer gas, which is within the chamber, is forced to flow from the chamber through the opening into the first arc region as the first contact means disengages from the third contact means to extinguish an arc between the first and third contact means and serially into the second arc region to extinguish an arc between the second and third contact means.

The present invention handles increased current connection and disconnection requirements without an increase in physical size and can replace physically large circuit-breakers. This is accomplished by providing multiple arc regions within the puffer circuit interrupter.

By having multiple arc regions which are serially cooled by a common jet of puffer gas, the instant invention has the same arc extinguishing and hence current interrupting capability in the first arc region as previous circuit interrupters, plus the additional arc extinguishing and current interrupting capability of the additional arc region(s). The jet of puffer gas flows out of the first arc region serially into each additional region. Between arc regions the gas recovers most of its arc extinguishing properties and thus is able to extinguish the arcs in those regions(s) also.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DETAILED DESCRIPTION

Figure 1:
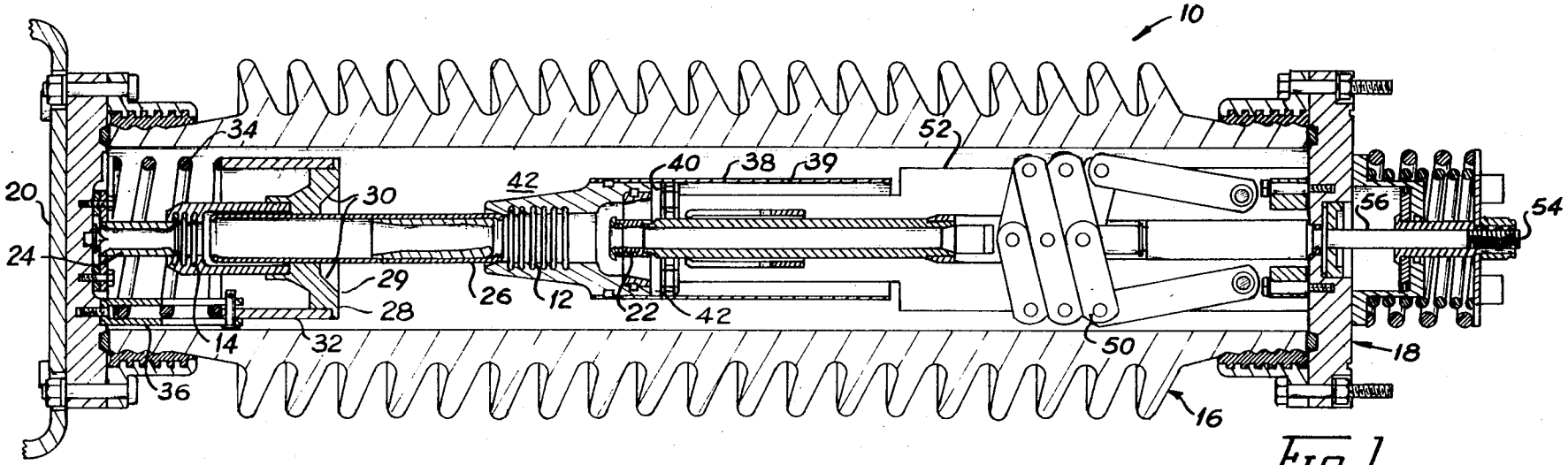
FIG. 1. is a diagrammatic longitudinal cross-sectional view of an embodiment of a puffer gas interrupter in the circuit open position.

Referring to FIG. 1, an embodiment of a puffer circuit interrupter 10 is shown. The interrupter 10 has a first arc region 12 and preferably a second arc region 14. The interrupter 10 includes an insulating tube 16 closed at each end by a first external terminal such as first metallic end plate 18, and a second external terminal metallic end plate 20. The external terminals provide electrical connections and physical support to the internal workings of the interrupter 10.

A first electrical contact 22, preferably a tubular elongated movable venting contact, is located within the insulating tube 16, and electrically connected to the first external terminal 18. A second electrical contact such as a tubular stationary venting contact 24, is located within the insulating tube 16 and electrically connected to the second external terminal 20. A third electrical contact such as a tubular elongated follow contact 26, is located within the insulating tube 16. The third electrical contact is movable relative to the first contact 22 into and out of elctrical engagement therewith and is movable relative to the second contact 24 into and out of electrical engagement therewith.

A fluid motor 38 is mounted upon the first contact 22. The fluid motor 38 has a chamber 40 which controllably communicates puffer gas 42, preferably sulfur hexafluoride, through an opening. The puffer gas 42 within the chamber 40 is forced to flow from the chamber 40, through the opening into the first arc region 12 as the first contact 22 disengages from the third contact 26 to extinguish an arc between the first and third contacts, and then serially into the second arc region 14 to extinguish an arc between the second contact 24 and the third contact 26.

The first arc region 12 shown in FIG. 1 is essentially identical to the only arc region in heretofore known interrupters and the fluid motor 38 is essentially identical to heretofore known interrupters. Therefore, if the second arc region 14 never opened, the circuit interrupter 10 would have essentially the same current and voltage interrupting capabilities as the heretofore known devices. However, the second arc region 14, because it does open and draw an arc which is extinguished by puffer gas 42 which flows from the fluid motor 38, through the first arc region 12, and the inside of the third contact 26, increases the circuit interrupter 10 current and voltage capabilities beyond those of the heretofore known interrupters without appreciable changes in outside physical dimensions.

Figure 3:
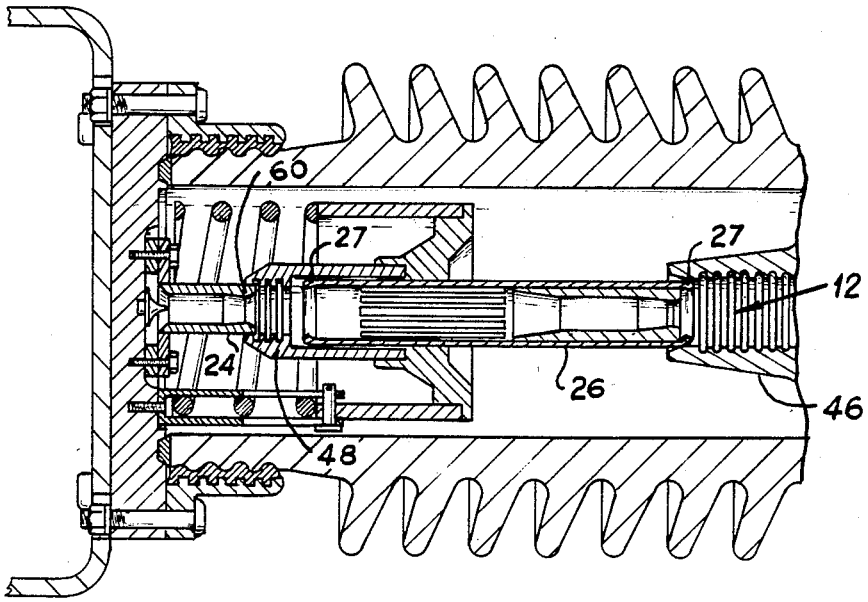
FIG. 3. is an enlarged partial view similar to portion of FIG. 1 showing the arc regions and contacts in the open position.

Referring to FIG. 3, the third electrical contact 26 preferably has annular electrical contacts 27 on each end. Preferably the third electrical contact 26 as slotted flexible contacts on each end to provide a mechanical biasing force against the respective mating contact in the circuit closed position.

Figure 4:
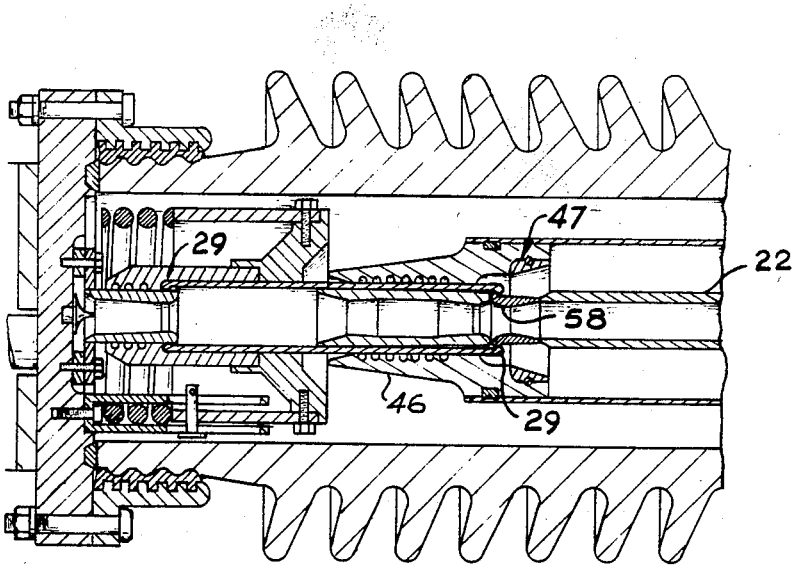
FIG. 4. is an enlarged partial view similar to FIG. 2 showing the arc regions and contacts in the closed position.

Referring to FIG. 3 and FIG. 4, the first electrical contact 22 preferably has an insulating nozzle 46 fixed thereon which surrounds one end of the first electrical contact 22 and the third electrical contact 26 and effects a sliding gas-seal therebetween.

Preferably, the insulating nozzle 46 directs the flow of puffer gas into the first arc region 12 to extinguish the arc therein. A cooler 47 may be mounted inside the insulating nozzle 46 to cool the puffer gas as it flows across it. The insulating nozzle 46 has annular ridges on its inside surface to prevent arc creepage between the first electrical contact 22 and the third electrical contact 26 in the circuit open position.

Figure 2:
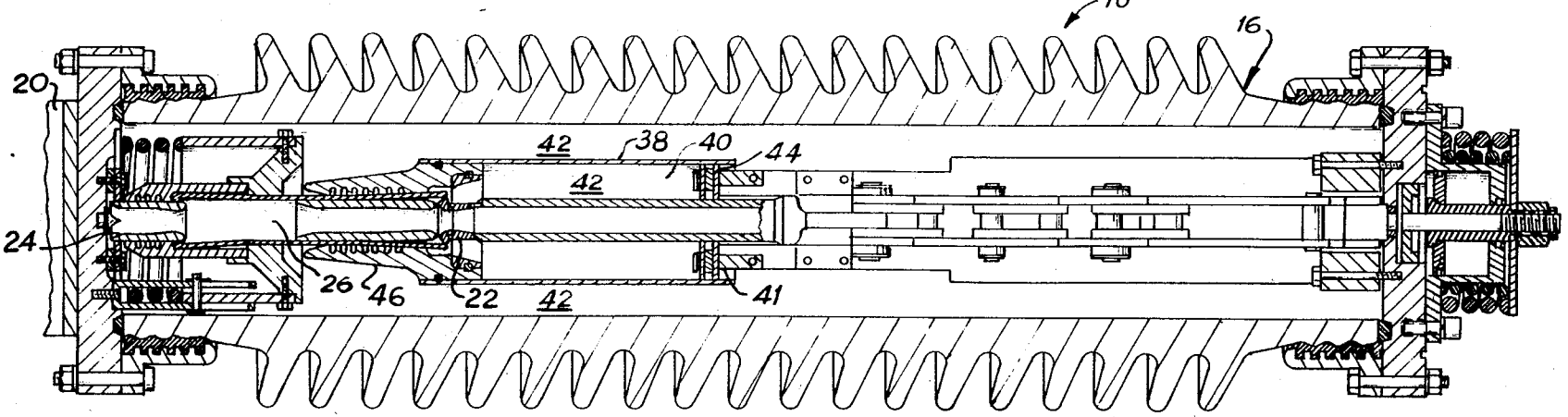
FIG. 2. is a diagrammatic longitudinal cross-sectional view of an embodiment of a puffer gas interrupter in the circuit closed position.

Referring to FIG. 1 and FIG. 2, the fluid motor 38 preferably has a piston 41, attached to first terminal 18 by an extension of guide 52, located concentrically about the first electrical contact 22 effecting a sliding gas-seal therewith. The piston 41 preferably has at least one one-way valve 44 allowing the fluid motor 38 to fill with puffer gas during circuit closing. Valve 44 blocks puffer gas passage during circuit opening. Preferably the fluid motor 38 has a movable cylinder 39 attached to the first contact 22 forming a chamber 40. The chamber 40 is filled with puffer gas 42 in the circuit-closed position. The chamber 42 decreases in volume with the progression of the circuit-opening motion compressing the puffer gas 42 until the valve-like abutting contact between the first and third contacts is separated allowing the puffer gas to escape the chamber.

Referring to FIG. 3 and FIG. 4, the puffer circuit interrupter preferably has an insulating flow guide 48 affixed to the third electrical contact 26, and concentrically surrounding one end of the third electrical contact 26 and the second electrical contact 24 effecting a sliding gas-seal therebetween.

Referring to FIG. 1 and FIG. 3, the puffer circuit interrupter preferably has a lost motion mechanism 29 fastened to the second terminal 20 and affixed to the third electrical terminal 26. Preferably the lost motion mechanism 29 has a spring 34, a spider 28 with a plurality of arms 30 fastened to the third electrical contact 26, an insulating tube 32 fastened to the spider 28 and riding on the spring 34, and a spring guide to direct and limit the spring expansion during circuit opening.

Referring to FIG. 3 and FIG. 4, preferably the first electrical contact 22 has an annular electrical contact 58 thereon. Preferably the second electrical contact 24 has an annular electrical contact 60 thereon.

In operation, a conductive path is provided from the first external terminal 18, and through first electrical contact 22, a third electrical contact 26, and a second electrical contact 24, to the second external terminal 20.

During circuit interruption, the improved capabilities of this invention are shown. As shaft 54 is pulled out of first external terminal 18, the stroke myltiplying or "lazy tongs" mechansim retracts the first electrical contact 22 in a direction away from the third electrical contact 26 and at the same time causes fluid motor 38 to begin compressing the puffer gas 42 within decreasing volume chamber 40 because the gas is temporarily blocked within the chamber 40 by the valve-like abutting action of the third contact 26 and the first contact 22 within the gas sealing insulating nozzle 46. As the first electrical contact 22 is retracted, a compressed spring 34 acting through insulating cylinder 32 and spider 28 expands providing a lost motion delay of the separation of the first and third contacts. Instead all of the first contact motion results in a separation of the second electrical contact 24 and the third electrical contact 26 drawing an arc in the second arc region 14. The third contact 26 continues to follow the first contact 22 and puffer gas 42 continues to be compressed within fluid motor 38 until spring 34 reaches the limit of spring guide 36. Once the limit of spring guide 36 is reached, first electrical contact 22 disengages from third electrical contact 26, drawing an arc in arc region 12 within insulating nozzle 46. At the same time the valve-like abutting contact between third contact 26 and first contact 22 is likewise disengaged releasing compressed puffer gas, such as sulfur hexafluoride, from fluid motor 38. The compressed puffer gas flows through insulating nozzle 46 into first arc region 12 puffing out the arc therein, then divides with part of the gas continuing to flow through third electrical contact 26 and insulating flow guide 48 into second arc region 14 puffing out the arc therein and exhausting through second contact 24 into the sealed volume within insulating tube 16. The remainder of the compressed puffer gas flows out of the first arc region 12 through the interior of first electrical contact 22 and is exhausted into the sealed volume within insulating tube 16. Thus, the arcs drawn during contact opening in all arc regions are puffed out, quickly interrupting a current flow of over ten times the steady state current rating and leaving a wider gas-filled-gap thereby providing an increase in interruption voltage rating between the external terminals at the current rating.

Thus, by using two or more arc chambers through which the compressed puffer gas is serially released, an increase in circuit interrupting capacity is achieved without an increase in physical size. Where desirable, the cooler element can be used to control the temperature of the puffer gas as it approaches the second of the series of arc chambers. The cooled puffer gas is then able to quench the second arc which means that the overall current interrupting capacity is increased.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A puffer circuit interrupter comprising:

insulating tube means having first and second spaced external terminal means thereon, said external terminal means communicating with the internal portion of said tube means;

first electrical contact means disposed within said tube means in electrical contact with said first external terminal means;

second electrical contact means disposed within said tube means in electrical contact with said second external terminal means;

third electrical contact means disposed within said tube means, said third contact means being movable relative to the first contact means into and out of a disposition of electrical engagement with said first contact means, said third contact means being movable relative to the second contact means into and out of a disposition of electrical engagement with said second contact means;

a volume of insulative puffer gas within said tube means;

fluid motor means disposed upon said first contact means, said fluid motor means defining a chamber and having an opening therein which controllably communicates with a first arc region between said first and third contact means and a second arc region between said second and third contact means, puffer gas within said chamber being forced to flow from the chamber through said opening into said first arc region as said first contact means disengages from said third contact means to affect any arc between said first and third contact means and serially into said second arc region as said second contact means disengages from said th.rrd contact means to affect any arc between said second and third contact means.

2. A puffer circuit interrupter as set forth in claim 1, wherein said third electrical contact means is of tubular construction.

3. A puffer circuit interrupter as set forth in claim 2, wherein said third electrical contact means has an annular electrical contact on each end.

4. A puffer circuit interrupter as set forth in claim 2, wherein said third electrical contact means has slotted flexible contacts on one end thereof to effect a mechanical biasing force against the respective mating contact when engaged.

5. A puffer circuit interrupter as set forth in claim 1, including an insulating nozzle means affixed to the first electrical contact and concentrically surrounding one end of the first and the third contacts to effect a slidable gas seal therebetween.

6. A puffer circuit interrupter as set forth in claim 5, wherein the insulating nozzle means directs the flow of gas from the fluid motor into the first arc region to extinguish the arc therein.

7. A puffer circuit interrupter as set forth in claim 6, wherein said insulating nozzle means has annular ridges on its inside surface spaced to prevent arc creepage.

8. A puffer circuit interrupter as set forth in claim 1, wherein the fluid motor means has a piston attached to interior of the first terminal means and disposed concentrically about the first electrical contact means effecting a sliding gas-seal contact therewith.

9. A puffer circuit interrupter as set forth in claim 8, wherein the piston has at least one one-way valve allowing the puffer gas to be drawn into the fluid motor means during engagement motion of the contacts and blocking puffer gas passage through the valves at other times.

10. A puffer circuit interrupter as set forth in claim 8, wherein the fluid motor means includes a movable cylinder attached to the first contact means towards the first arc region end thereon and concentrically surrounding part of the first contact means and the piston to define the chamber thereby.

11. A puffer circuit interrupter as set forth in claim 10, wherein the chamber is filled with puffer gas at substantially the same pressue as the puffer gas residing in the remainder of the insulating tube means when all contacts are engaged, said chamber decreasing in volume with the progression of the disengagement motion compressing the puffer gas therein trapped by the one-way valves and the physical seal between the first and third contact until the first and third contacts separate allowing the compressed puffer gas to escape.

12. A puffer circuit interrupter as set forth in claim 1, including an insulating flow guide affixed to the third electrical contact and concentrically surrounding one end of the third and second contacts effecting a slidable gas seal therebetween.

13. A puffer circuit interrupter as set forth in claim 1, including a lost-motion means being fastened to the second external terminal means and affixed to the third contact means.

14. A puffer circuit interrupter as set forth in claim 13, wherein the lost-motion means includes:

a spring;

a spider with a plurality of arms disposed concentrically about and fastened to the third contact;

an insulating tube fastened to the spider and riding upon the spring; and a spring guide having a spring extension limit and operating during contact disengagement to keep the third contact engaged with the first contact until the spring extension limit is met causing a cessation of the lost-motion action and separating the third and first contacts.

15. A puffer circuit interrupter, comprising:

insulating tube means having first and second spaced external terminal means thereon, communicating with the internal portion of said tube means;

first electrical contact means having a tubular construction with a first annular electrical contact affixed to one end surrounded by an insulating nozzle and the other end being open within said tube means in electrical contact with said first external terminal means;

second electrical contact means having a tubular construction with a second annular electrical contact affixed to the end towards the interior of said tube means and the other end being open and disposed within said tube means in electrical contact with said second external terminal means;

third electrical contact means having a tubular construction with a third annular electrical contact affixed to one end thereof and a fourth annular electrical contact affixed to the other end thereof, said third contact means having an insulating flow guide surrounding the contact end toward said second contact disposed within said tube means, said third contact means being movable relative to the first contact means into and out of a disposition of electrical engagement with said first contact means and said third and first electrical contacts being disposed within said insulating nozzle and physically contacting said insulating nozzle to effect a gas seal therewith, said third contact means being movable relative to the second contact means into and out of electrical engagement with said second contact means and said third and second electrical contact means being disposed within said insulating flow guide and physically contacting said insulating flow guide nozzle to effect a gas seal therewith;

fluid motor means disposed upon said first contact means, said fluid motor means defining a chamber with an opening controllably communicating with the first arc region between said third and second contact means;

puffer gas within said chamber being forced to flow by said fluid motor means from the chamber through said chamber opening into said first arc region as said first contact means disengages from said third contact means to extinguish the arc drawn therebetween, said gas dividing with one portion thereof being forced to flow over the exterior of the first electrical contact means and the annular electrical contacts affixed thereto, said gas portion being exhausted through the hollow interior of said first contact means into the interior of said insulating tube means, the remaining portion of said gas being forced to flow through said insulating nozzle means inside said third annular electrical contact into the interior of said third contact means, said remaining gas portion being forced further to flow through the interior of said third contact and out of the said fourth annular electrical contact into said second arc region as said second contact means disengages from said third contact means to extinguish the arc drawn therebetween and into said second annular electrical contact into the hollow interior of said second contact means, and being exhausted from said second contact means into the interior of said insulating tube means.

16. A puffer circuit interrupter as set forth in claim 15, wherein both ends of the third contact means are slotted and flexibly expand when electrically engaged with said first and second contact means and provide biasing forces for each respective contact engagement.

17. A puffer circuit interrupter, comprising:

insulating tube means;

a first metallic end-plate member closing one open end of said insulating case means;

a second metallic end-plate member closing the other open end of said insulating case means;

a tubular stationary venting contact mounted on the inner side of said second metallic end-plate member;

a movable tubular assembly having axially extending insulating flow guide and a tubular elongated follow contact making gas sealing contact with said stationary contact of the circuit interrupter;

a lost motion means including a spring storing energy during contact engagement and releasing energy providing the lost-motion to the follow contact during contact disengagement, an insulating cylinder riding upon the spring essentially coaxial with follow contact, a spider member having a plurality of arms and being affixed to the follow contact and the insulating cylinder, and a spring guide guiding and limiting the expansion of the spring;

an insulating nozzle and a tubular elongated movable venting contact making gas sealing contact at all times and valve-like abutting engagement with said follow contact in the closed circuit position of the circuit interrupter;

fluid motor means including a fixed piston member located intermediate the ends of said insulated tube means and a movable cylinder which operatively slides over said fixed piston member during the opening operation to thereby compress the gas therewithin;

supporting means affixed to the inner side of said first metallic end-plate member and extending interiorly of said insulating tube means to fixably support therein said fixed piston member, said axially-extending hollow insulating nozzle surrounding said follow contact in the closed-circuit position of the circuit interrupter;

means defining a cooler member disposed entirely interiorly of said hollow insulating nozzle so as not to project externally up to the surface of said fluid motor, said movable and follow contacts being separable to establish an arc during a circuit-interrupter opening operation, said cooler member being closely located to the contact tip of the movable tubular venting elongated contact so as thereby to cool the compressed gas ejected from the fluid motor through said hollow insulating nozzle and axially along said drawn arc, the abutting contacting engagement between the follow and the movable venting contacts during the opening operation of the circuit-interrupter and also during the time of take-up of the lost motion travel of the follow contact providing a desirable valve-closed action to thereby retain and build up gas pressure during the compression phase within said fluid motor until a predetermined time, coincident with the take-up of said lost motion between the movable and follow contacts, whereupon contact separation between the movable and follow contacts occurs and only then compressed gas ejection takes place through the hollow insulating nozzle for arc extinction purposes between the movable and follow contacts, the gas then continuing through the follow contact to the insulating flow guide for arc extinction purposes betwen the follow and stationary contacts therein; supporting means affixed to the inner side of the first metallic-end-plate member including longitudinally-extending guide rail means; and a stroke multiplying operating mechanism disposed internally of said insulating tube means and guides by said guide rail means to provide a very fast opening and closing motion of the fluid motor and the movable venting contact therein.

18. A puffer circuit interrupter as set forth in claim 17, including a second cooler member disposed within the interior of the lost motion means.

* * * * *

UNITED STATES PATENT AND TRADEMARK OFFICE

CERTIFICATE OF CORRECTION

PATENT NO. : 4,568,806

DATED : February 4, 1986

INVENTOR(S) : Russell E. Frink

It is certified that error appears in the above-identified patent and that said Letters Patent is hereby corrected as shown below:

Column 6, line 15, Claim 1, "th.rrd" should read -- third --.

Signed and Sealed this

*Thirteenth* Day of *May 1986*

[SEAL]

*Attest:*

DONALD J. QUIGG

*Attesting Officer*

*Commissioner of Patents and Trademarks*